US009797219B2

(12) United States Patent
Al-Badran

(10) Patent No.: US 9,797,219 B2
(45) Date of Patent: Oct. 24, 2017

(54) REMEDIAL SECOND-STAGE CEMENTING PACKER

(71) Applicant: Saudi Arabian Oil Company, Dhahran (SA)

(72) Inventor: Mohammed Al-Badran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 475 days.

(21) Appl. No.: 14/521,721

(22) Filed: Oct. 23, 2014

(65) Prior Publication Data

US 2016/0115752 A1 Apr. 28, 2016

(51) Int. Cl.

| | |
|---|---|
| ***E21B 33/14*** | (2006.01) |
| ***E21B 33/138*** | (2006.01) |
| ***E21B 33/129*** | (2006.01) |
| *E21B 23/06* | (2006.01) |

(52) U.S. Cl.
CPC ..... *E21B 33/138* (2013.01); *E21B 33/129* (2013.01); *E21B 33/146* (2013.01); *E21B 23/06* (2013.01)

(58) Field of Classification Search
CPC ..... E21B 33/146; E21B 33/138; E21B 33/129
See application file for complete search history.

(56) References Cited

U.S. PATENT DOCUMENTS

| | | | | |
|---|---|---|---|---|
| 5,178,219 | A * | 1/1993 | Striech | E21B 33/124 166/127 |
| 7,000,697 | B2 | 2/2006 | Goode et al. | |
| 2009/0301720 | A1 | 12/2009 | Edwards et al. | |
| 2013/0319671 | A1 | 12/2013 | Lund et al. | |

FOREIGN PATENT DOCUMENTS

| | | | |
|---|---|---|---|
| CN | 201460798 | U | 5/2010 |
| CN | 202596642 | U | 12/2012 |
| FR | 868771 | A | 1/1942 |
| RU | 2386013 | C1 | 10/2010 |

OTHER PUBLICATIONS

PCT International Search Report and The Written Opinion of the International Searching Authority dated Feb. 12, 2016; International Application No. PCT/US2015/056957; International Filing Date: Oct. 22, 2015.

* cited by examiner

*Primary Examiner* — David Andrews
*Assistant Examiner* — Kristyn Hall
(74) *Attorney, Agent, or Firm* — Bracewell LLP; Constance Gall Rhebergen

(57) ABSTRACT

A method for cementing an annular space outside of an inner casing of a subterranean well includes running and setting a cement packer assembly into a bore of the inner casing. The cement packer assembly includes a plurality of nails spaced around a circumference of the cement packer assembly. Slips are set and a lower end of each of the nails is pushed through the inner casing with a setting tool to form holes. A middle portion of the nails having a smaller outer dimension than the lower end of the nails is positioned within the holes. Cement is pumped through the inner casing, through the holes and into the annular space. A force is applied to the nails to move the nails through the holes and position a seal plate of each nail against an inside surface of the bore surrounding one of the holes.

19 Claims, 3 Drawing Sheets

REMEDIAL SECOND-STAGE CEMENTING PACKER

BACKGROUND OF THE INVENTION

1. Field of the Invention

The present invention relates generally to downhole tools for use in subterranean wells, and more specifically to a tool for use in cementing operations within a subterranean well.

2. Description of the Related Art

When a subterranean well, such as a well used in hydrocarbon development, is drilled it sometimes has a number of tubulars or casings of various diameters. The upper portion of the well have the largest diameter casing, which can be cased and cemented in one step. For deeper wells, such as, for example, wells that are 5000 feet deep or more, in the lower part of the well smaller diameter inner casing is run to the bottom of the drilled hole and cemented in two stages. The bottom most part of the casing is cemented using traditional means, such as by pumping cement through the casing shoe. An upper portion can be cemented using a second-stage tool, which is sometimes referred to as a multi-stage tool. The second-stage tool can be associated with the inner casing and includes an annular packer that seals the annular space between the inner casing and the bore of the well or an outer casing. The annular packer isolates a lower part of the annular space from the upper part of the annular space which is above the annular packer. The second-stage tool has ports that extend through the inner casing to allow circulating fluids to flow through the ports and into the upper part of the annular space.

The second-stage cementing process allows the cement to enter the annular space at a distance above the bottom of the well, preventing the entire hydraulic pressure of the weight of the column of cement being exerted on the bottom of the well. It also enables cementing the upper part of the hole in case a low pressure zone, known as loss circulation zone, is encountered in the middle portion of the well. The first step of the two stage cementing can be performed by pumping enough cement into the lower part of the annular space and up to the depth of the second-stage tool, or to the depth of loss circulation zone, as applicable. Then the annular packer is set to isolate the lower part of the annulus, and the ports are opened to circulate cement into the annular space above the annular packer. Mechanical and hydraulic means can be used to set, to open, and to close the second-stage cementing tools depending on the model of second-stage tool used.

Failure of the second-stage and off-bottom casing cementing process is common. For example, the second-stage tool can fail to open, leaving the annular space above the second-stage tool without cement. Such failure results in significant cost increases and time delays and affects the condition of the well. If alternate means for cementing the annular space are not possible, the upper part of the inner casing is left non-cemented, which will shorten the well life significantly. Traditional methods to mitigate the failure are complicated procedures and can result in substandard well conditions or can result in changing the well design to less than desired casing sizes and reducing well integrity.

As an example, whenever second-stage tool fails to open, a cement bond log can be run to determine the level of cement in the annular space. The inner casing can be perforated above the second-stage tool and a cement retainer packer can be run above the perforations. Cement can be circulated through the new perforations into the upper annular space. The perforations can then be scabbed off with smaller casing, which procedure is mandatory in some countries, or with casing patches where allowed. Forming the perforations risks damaging the next casing or the outer casing and introduces safety risks with the handling of explosive material required for the perforation gun. In addition, having to scab off the perforations will result in a reduced inner diameter of the inner casing, which can reduce the well production and injection rates and can limit options for future well interventions.

Alternately, for shallow wells, cement can be dumped into the annual space from the surface. This generally results in substandard quality cement.

SUMMARY OF THE DISCLOSURE

Embodiments of the present disclosure provide systems and methods that can perform each of the required functions of sealing across the inner casing, creating holes through the inner casing, and then sealing the holes through the inner casing. Embodiments of this disclosure can also be easily repeated in case of failure. The systems and methods of this disclosure do not require explosive materials and eliminate the need of extra casing or patches to seal the holes through the inner casing.

In an embodiment of this disclosure, a method for cementing an annular space outside of an inner casing of a subterranean well includes running and setting a cement packer assembly into a bore of the inner casing. The cement packer assembly includes a plurality of nails spaced around a circumference of the cement packer assembly. Slips are set and a lower end of each of the nails is pushed through the inner casing with a setting tool coupled to the cement packer assembly, each of the nails forming a hole through the inner casing. A middle portion of the nails is positioned within the holes, the middle portion of the nails having a smaller outer dimension than the outer dimension of the lower end of the nails. Cement is pumped through the inner casing, through the holes, and into the annular space. A force is applied to the nails to move the nails through the holes and position a seal plate of each nail against an inside surface of the bore surrounding one of the holes.

In an alternate embodiment, after running and setting a cement packer assembly into a bore of the inner casing, the cement packer assembly can be isolated from fluids and pressure within the bore by setting a lower seal that extends across the bore and by setting an upper seal that has a ring shape and circumscribes the setting tool. The step of running and setting the cement packer assembly into the bore of the inner casing can include setting the cement packer axially above a failed second-stage cement tool or axially above an annular packer that seals the annular space. The cement packer assembly can be run into the bore of the inner casing with a drill pipe.

In other alternate embodiments, the step of the setting slips and pushing the lower end of each of the nails through the inner casing, with the setting tool can be accomplished by rotating the setting tool. The force can be applied to the nails by landing a dart in a landing seat of the cement packer assembly. The step of pushing the lower end of each of the nails through the inner casing can include engaging a sloped surface of the cement packer assembly with each of the nails, pushing the lower end of each of the nails through the inner casing at an angle relative to a central axis. The step of applying a force to the nails to move the nails through the holes and position a seal plate of each nail against an inside surface of the bore surrounding one of the holes can include positioning a nail seal of each nail within one of the holes. The method can further include de-coupling the setting tool from the cement packer assembly and retrieving the setting tool, and then drilling out the cement packer assembly.

In an alternate embodiment of this disclosure, a method for cementing an annular space between an inner casing and an outer casing of a subterranean well includes running a cement packer assembly into a bore of the inner casing above an annular packer that seals the annular space. The cement packer assembly includes a plurality of nails spaced around a circumference of the cement packer assembly. Axial movement of the cement packer assembly is prevented by setting slips of the cement packer assembly to engage an inner surface of the bore. A lower end of each of the nails is pushed through the inner casing with a setting tool coupled to the cement packer assembly, each of the nails forming a hole through the inner casing. A middle portion of the nails is positioned within the holes. The middle portion of the nails has a smaller outer dimension than the outer dimension of the lower end of the nails. Cement is pumped through the inner casing, through the holes and into the annular space. Each of the holes is sealed with a nail seal of each nail and a seal plate of each nail by moving each of the nails through one of the holes to position the seal plate of each nail against an inside surface of the bore surrounding one of the holes and locating each of the nail seals within one of the holes. The lower end of each of the nails is spaced apart from the outer casing.

In alternate embodiments, after running the cement packer assembly into the bore, the cement packer assembly can be isolated from fluids and pressure within the bore, by setting a lower seal that extends across the bore and by setting an upper seal that has a ring shape and circumscribes the setting tool. The step of sealing each of the holes includes landing a dart in a landing seat of the cement packer assembly to apply a downward force to each of the nails. The step of pushing the lower end of each of the nails through the inner casing can include engaging a sloped surface of the cement packer assembly with each of the nails and pushing the lower end of each of the nails through the inner casing at an angle relative to a central axis. The method can further include de-coupling the setting tool from the cement packer assembly and retrieving the setting tool with a drill pipe, then drilling out the cement packer assembly.

In yet another alternate embodiment of the current disclosure, an apparatus for cementing an annular space outside of an inner casing of a subterranean well includes a cement packer assembly. The cement packer assembly has a plurality of nails spaced around a circumference of the cement packer assembly, each of the nails having a lower end and a middle portion with a smaller outer dimension than an outer dimension of the lower end. The cement packer assembly also has slips having outer surfaces selectively engaging an inner surface of a bore of the inner casing. A seal plate is associated with each nail, the seal plate having a curved outer surface for mating with the inner surface of the bore. A setting tool is coupled to the cement packer assembly.

In alternate embodiments, the apparatus can have a lower seal that extends across the bore and an upper seal that has a ring shape and circumscribes the setting tool. The cement packer assembly can have a sloped surface selectively directing the lower end of each of the nails through the inner casing at an angle relative to a central axis so that each of the nails forms a hole in the inner casing. The cement packer assembly can also have a landing seat selectively receiving a dart landed in the cement packer assembly to move each of the nails through one of a plurality of holes through the inner casing to position a seal plate of each nail against an inside surface of the bore surrounding one of the holes. Each nail can have a nail seal selectively sealingly positioned within one of a plurality of holes through the inner casing.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
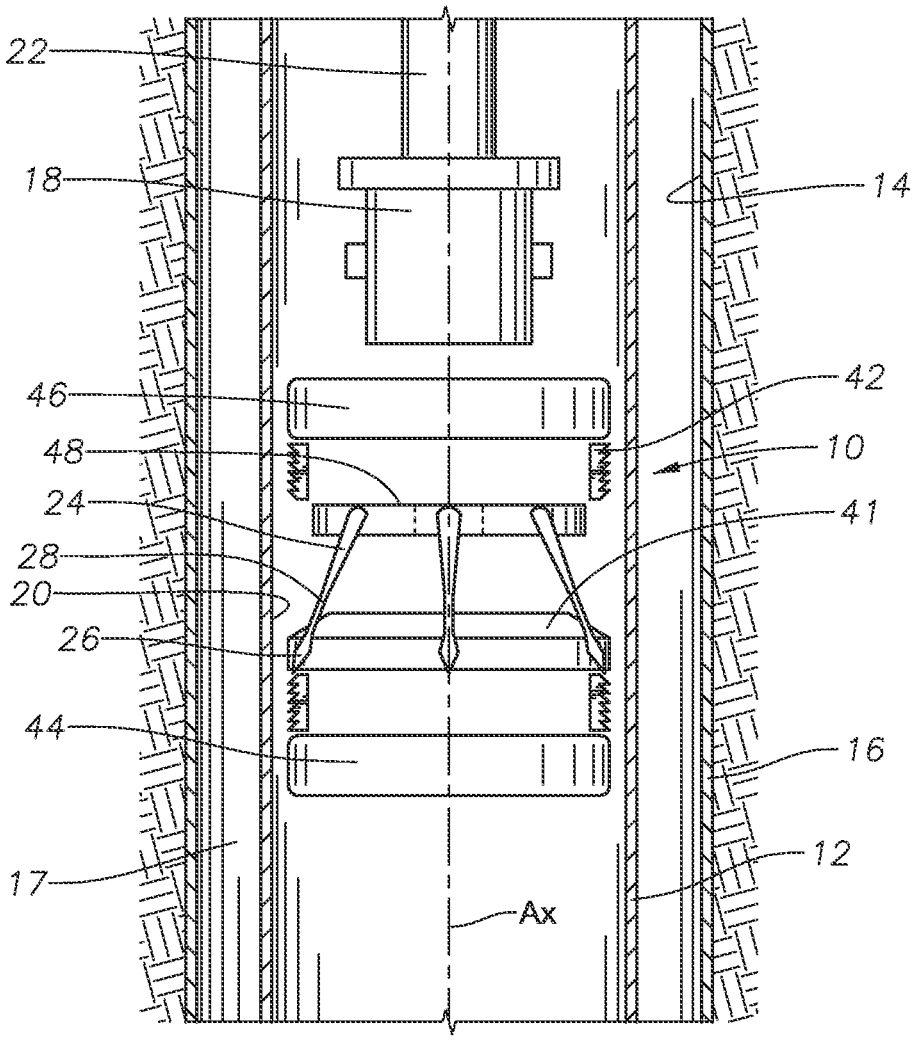
FIG. 1 is a section view of a cement packer assembly being lowered into an inner casing, in accordance with an embodiment of this disclosure.

Referring to FIG. 1, cement packer assembly 10 is shown being lowered into inner casing 12 of a subterranean well 14 along central axis Ax. Inner casing 12 can be located concentrically within outer casing 16, as shown, or alternately can be located within an uncased well bore, defining annular space 17 outside of inner casing 12. Cement packer assembly can be coupled to setting tool 18 and run into bore 20 of inner casing 12 on drill pipe 22.

Figure 4:
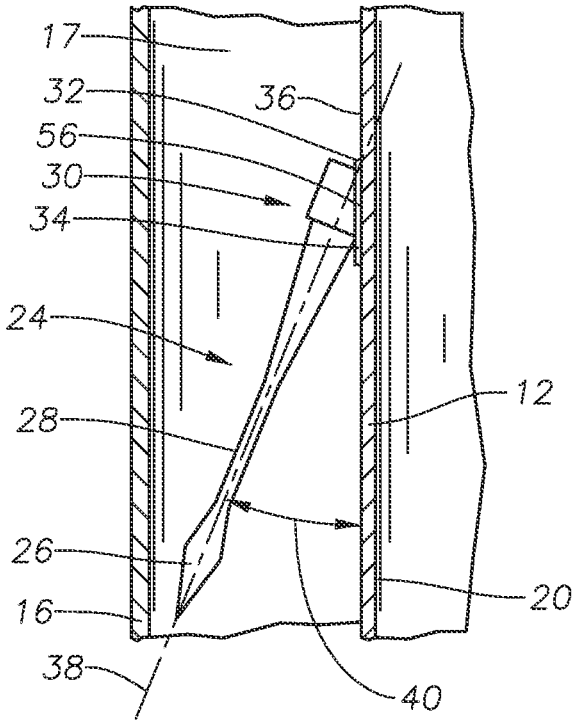
FIG. 4 is a section view of one of the nails of the cement packer assembly of FIG. 1, shown through a hole of the inner casing.
Figure 5:
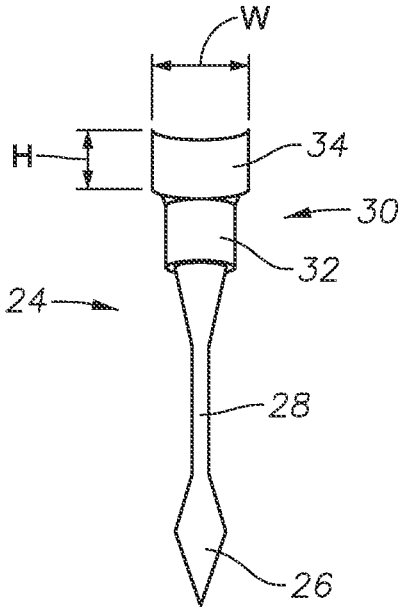
FIG. 5 is a perspective view of one of the nails of the cement packer assembly of FIG. 1.

Cement packer assembly 10 includes a plurality of nails 24 that are spaced around a circumference of cement packer assembly 10. Looking now at FIGS. 4-5, each nail 24 has lower end 26. Lower end 26 of nail 24 has a sharp pointed end for piercing inner casing 12. Lower end 26 has an increased outer dimension adjacent to the sharp pointed end. Lower end 26 can have a generally diamond shaped cross section, as shown, or alternately can have an arrow shape in cross section, an upside down tear drop shape in cross section, or other type of cross section that has a sharp pointed end followed by an increased outer dimension. If nail 24 is symmetrical about nail axis 38, then the outer dimensions will be outer diameters.

Each nail 24 also has middle portion 28. Middle portion 28 has a smaller outer dimension than the increased outer dimension of lower end 26. Each nail 24 further includes an upper nail assembly 30. Upper nail assembly 30 is at an end of nail 24 on an opposite side of middle portion 28 than lower end 26. Upper nail assembly 30 includes nail seal 32 and seal plate 34. Nail seal 32 is a sealing member and has a cross sectional dimension that is at least as large as the increased outer dimension of lower end 26. Nail seal 32 can be formed of rubber or other elastomeric material that can form a seal and maintain such seal at the working temperatures and pressures of the subterranean well.

Seal plate 34 is an arc shaped segment of plate. Seal plate 34 can have an outer surface that has a radius of curvature that matches a radius of curvature of the inner surface of bore 20. The height H and width W of the outer surface of seal plate 34 are each larger than the increased outer dimension of lower end 26 of nail 24. A plate axis 36 that extends in the direction of the height H of seal plate 34 is set at an angle 40 relative to nail axis 38 that extends along nail 24. Plate axis 36 is parallel to central axis Ax. The length of nail 24 along nail axis 38 is such that when seal plate 34 engages the inner surface of bore 20, lower end 26 of nail 24 does not extend to outer casing 16, but is instead spaced apart from outer casing 16.

Figure 2:
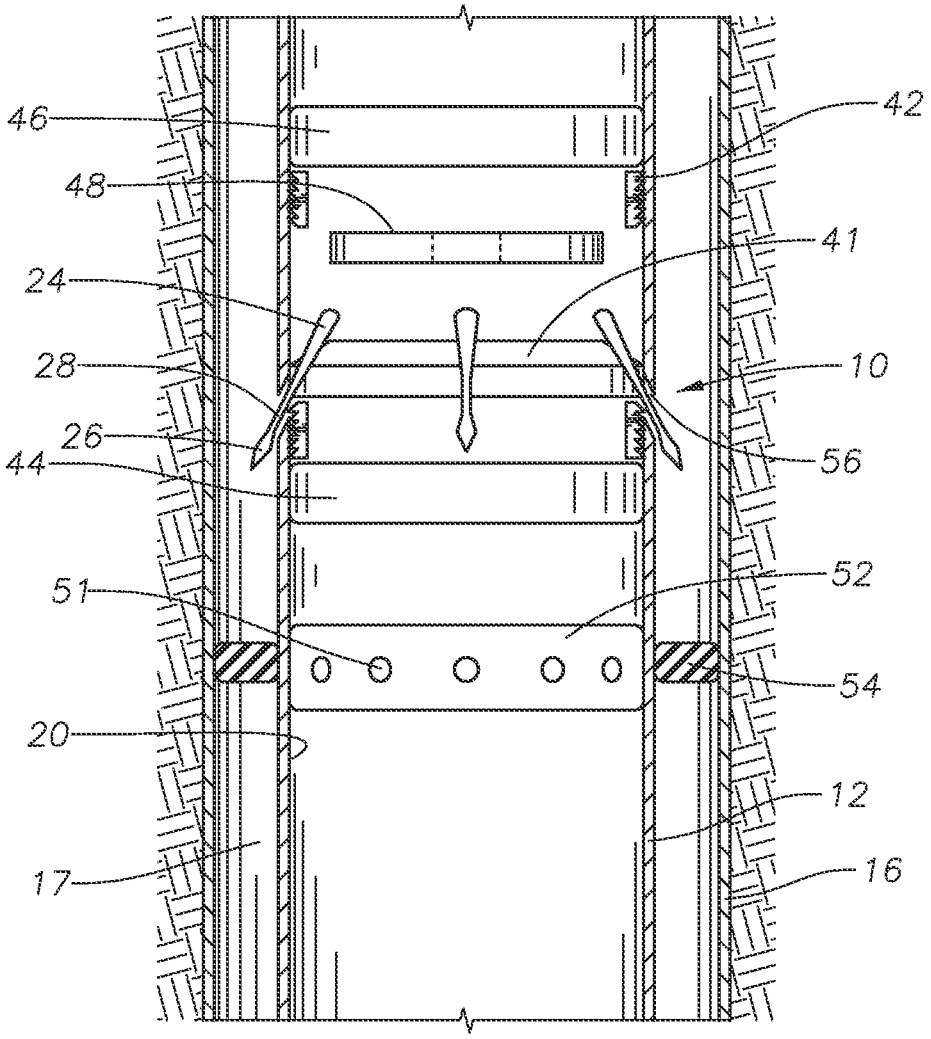
FIG. 2 is a section view of the cement packer assembly of FIG. 1, with the nails located through holes in the inner casing.
Figure 3:
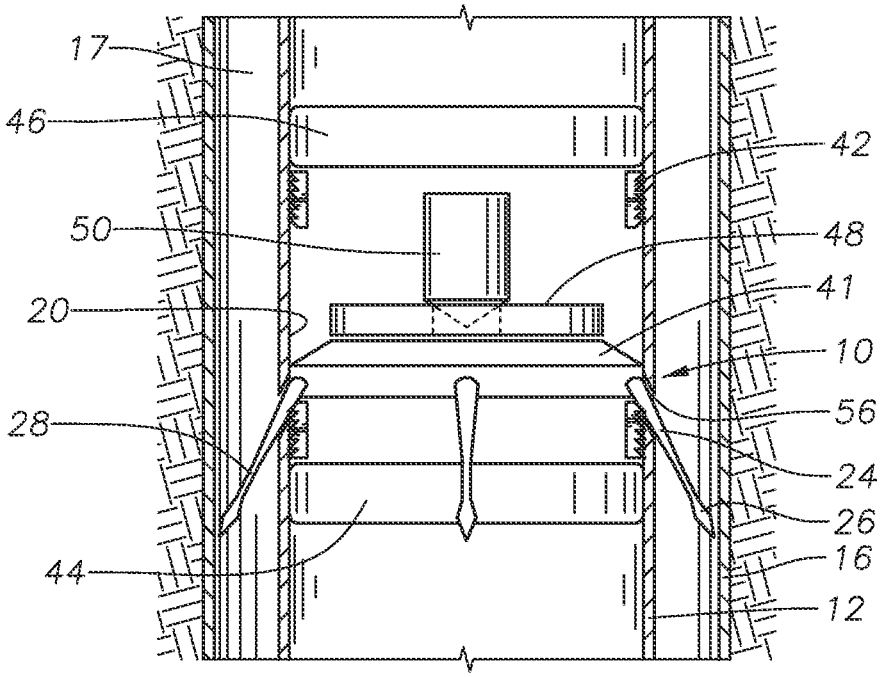
FIG. 3 is a section view of the cement packer assembly of FIG. 1, with the nails sealing the holes in the inner casing.

Turning now to FIGS. 1-3, cement packer assembly 10 has sloped surface 41. Sloped surface 41 has an outer surface that is set at an angle about the same as angle 40 so that lower end 26 of nail 24 can slidingly engage sloped surface 41 and nail 24 can be directed along sloped surface 41. Sloped surface 41 can be, for example, a frusto conical surface within cement packer assembly 10 having a larger circumference at a lower end of sloped surface 41 than the circumference of sloped surface 41 at an upper end of sloped surface 41.

Cement packer assembly 10 also includes slips 42. Slips 42 have outer surfaces that can engage the inner surface of bore 20. Slips 42 can have teeth that bite into the inner surface of bore 20 and are shaped to resist upward movement of cement packer assembly 10 relative to inner casing 12, or resist downward movement of cement packer assembly 10 relative to inner casing 12. During the running of cement packer assembly 10 into inner casing 12, slips 42 can be spaced radially inward from the inner surface of bore 20. Slips 42 can be set by setting tool 18, such as, for example, by rotation of setting tool 18. In the example shown in FIGS. 1-3, slips 42 at an upper end of cement packer assembly 10 resist upward movement of cement packer assembly 10 relative to inner casing 12 and slips 42 located at a lower end of cement packer assembly 10 resist downward movement of cement packer assembly 10 relative to inner casing 12.

Still looking at FIGS. 1-3, cement packer assembly 10 also has lower seal 44 and upper seal 46. Lower seal 44 can extend across bore 20, sealing and isolating cement packer assembly 10 from fluids and pressure located within bore 20 axially below lower seal 44. Upper seal 46 is a ring shaped seal that circumscribes setting tool 18, forming a seal around setting tool 18 and between setting tool 18 and bore 20. Upper seal 46 isolates cement packer assembly 10 from fluids and pressure located within bore 20 axially above upper seal 46. During the running of cement packer assembly 10 into inner casing 12, the outer dimension of both lower seal 44 and upper seal 46 can be spaced radially inward from the inner surface of bore 20.

Cement packer assembly 10 additionally includes landing seat 48. Landing seat 48 is located axially between lower seal 44 and upper seal 46. Landing seat 48 is shaped to accept dart 50 and to move axially downward relative to lower seal 44 and upper seal 46 when dart 50 is landed on landing seat 48. Nails 24 can be attached to landing seat 48 with shear pin assemblies (not shown). The shear pin assemblies can allow for some relative movement between landing seat 48 and nails 24, but will retain nails 24 in a desired position until shear members of the shear pin assemblies are sheared. Dart 50 is formed of a drillable material.

The elements of cement packer assembly 10 can be threaded together, in a manner known in the art. In addition, setting tool 18 can be connected to cement packer assembly 10, by methods known in the industry, for example, by J-Sleeve, pressure rated pins or tension sleeves.

In an example of operation, in the event of a failed second-stage cementing operation, such as the failure of openings 51 of failed second-stage cement tool 52 to open, a path through bore 20 that is sufficient to allow the passage of cement packer assembly 10 can be confirmed, and formed, as required. Cement packer assembly 10 can be run into bore 20 of inner casing 12. Cement packer assembly 10 can be coupled to setting tool 18 and run into bore 20 with drill pipe 22. Looking at FIG. 2, cement packer assembly 10 can be set axially above failed second-stage cement tool 52 or above an existing annular packer 54 that seals annular space 17.

Cement packer assembly 10 can then be isolated from fluids and pressure within bore 20 by setting lower seal 44 and upper seal 46. Lower seal 44 and upper seal 46 can be set by conventional methods, such as by using a tension sleeve (not shown) that is rotated clockwise and counter clockwise by setting tool 18. Slips 41 can then be set to resist and prevent axial movement of cement packer assembly 10 relative to bore 20. This can be accomplished, for example, by rotating setting tool 18. Slips 41 can be set by conventional means, such as by rotation of setting tool 18 clockwise and counterclockwise. Lower end 26 of each nail 24 can then be pushed through inner casing 12 to form a hole 56 through inner casing 12. This can also be accomplished, for example, with the rotation of setting tool 18 clockwise and counterclockwise. As nails 24 move axially downward to form holes 56, lower end 26 of each nail can engage sloped surface 41 of cement packer assembly 10 so that nails 24 extend through inner casing 12 at angle relative 40 to a plate axis 36 and central axis Ax.

Lower end 26 of each nail 24 will continue through inner casing 12 until lower end 26 is located within annular space 17. Middle portion 28 of each nail 24 will be positioned in one of the holes 56. Because middle portion 28 has a smaller outer dimension than the outer dimension of lower end 26, there is open space within each hole 56 around middle portion 28. Cement can then be pumped through drill pipe 22, into cement packer assembly 10, and out into annular space 17 by way of holes 56. Because existing annular packer 54 seals annular space 17 below cement packer assembly 10, the cement will fill annular space 17 axially above existing annular packer 54 and cement packer assembly 10. The shear pin assemblies, or other connection means, between landing seat 48 and nails 24 will retain nails 24 in the desired position with middle portion 28 of each nail 24 positioned in one of the holes 56.

After the calculated required cement volume is pumped into drill pipe 22, it is displaced with dart 50 followed by heavy mud pumped into drill pipe 22. Dart 50 lands in landing seat 48 and applies a force to nails 24 to move nails 24 through holes 56 and position seal plate 34 of each nail 24 against the inside surface of bore 20 surrounding each of the holes 56. In such a position, nail seal 32 of each nail 24 will be located within one of the holes 56. The combination of seal plate 34 and nail seal 32 will create a pressure and fluid seal across such hole 56. The length of nails 24 along nail axis 38 is short enough that lower end 26 of each of the nails 24 is spaced apart from outer casing 16 so that nails 24 cannot damage outer casing 16. Shear members of the shear pin assemblies can be sheared so that nails 24 are no longer connected to landing seat 48 and nails 24 remain within holes 56.

Setting tool 18 can then be de-coupled from cement packer assembly 10 and retrieved by pulling drill pipe 22 out of bore 20. The remaining components of cement packer assembly 10, including landing seat 48, sloped surface 41, and lower seal 44 and upper seal 46, as well as dart 50 can be drilled out, each of such components being formed of a drillable material. The integrity of the seal across holes 56 can be tested. In such a manner, cement packer assembly 10 can perform each of the required functions of isolating cement packer assembly 10 within inner casing 12, creating holes 56 through the inner casing 12, and then after cementing operations, sealing holes 56 through inner casing 12.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

That claimed is:

1. A method for cementing an annular space outside of an inner casing of a subterranean well, the method comprising:

(a) running and setting a cement packer assembly into a bore of the inner casing, the cement packer assembly including a plurality of nails spaced around a circumference of the cement packer assembly;

(b) setting slips and pushing a lower end of each of the nails through the inner casing, with a setting tool coupled to the cement packer assembly, each of the nails forming a hole through the inner casing;

(c) aligning a middle portion of the nails within the holes, the middle portion of the nails having a smaller outer dimension than the outer dimension of the lower end of the nails;

(d) pumping cement through the inner casing, through the holes and into the annular space; and (e) applying a force to the nails to move the nails through the holes and position a seal plate of each nail against an inside surface of the bore surrounding one of the holes.

2. The method according to claim 1, further comprising after step (a), isolating the cement packer assembly from fluids and pressure within the bore, by setting a lower seal that extends across the bore and by setting an upper seal that has a ring shape and circumscribes the setting tool.

3. The method according to claim 1, wherein step (e) further comprises positioning a nail seal of each nail within one of the holes.

4. The method according to claim 1, wherein the step of running and setting the cement packer assembly into the bore of the inner casing includes setting the cement packer axially above a failed second-stage cement tool.

5. The method according to claim 1, wherein the step of running and setting the cement packer assembly into the bore of the inner casing includes setting the cement packer axially above an annular packer that seals the annular space.

6. The method according to claim 1, wherein the step of running and setting the cement packer assembly into the bore of the inner casing includes running the cement packer assembly into the bore with a drill pipe.

7. The method according to claim 1, wherein the step of applying the force to the nails comprises landing a dart in a landing seat of the cement packer assembly.

8. The method according to claim 1, wherein the step of pushing the lower end of each of the nails through the inner casing includes engaging a sloped surface of the cement packer assembly with each of the nails, pushing the lower end of each of the nails through the inner casing at an angle relative to a central axis.

9. The method according to claim 1, wherein the step of the setting slips and pushing the lower end of each of the nails through the inner casing, with the setting tool comprises rotating the setting tool.

10. The method according to claim 1, further comprising de-coupling the setting tool from the cement packer assembly and retrieving the setting tool, and drilling out the cement packer assembly.

11. A method for cementing an annular space between an inner casing and an outer casing of a subterranean well, the method comprising:

(a) running a cement packer assembly into a bore of the inner casing above an annular packer sealing the annular space, the cement packer assembly including a plurality of nails spaced around a circumference of the cement packer assembly;

(b) preventing axial movement of the cement packer assembly by setting slips of the cement packer assembly to engage an inner surface of the bore;

(c) pushing a lower end of each of the nails through the inner casing, with a setting tool coupled to the cement packer assembly, each of the nails forming a hole through the inner casing;

(d) aligning a middle portion of the nails within the holes, the middle portion of the nails having a smaller outer dimension than the outer dimension of the lower end of the nails;

(e) pumping cement through the inner casing, through the holes and into the annular space; and (f) sealing each of the holes with a nail seal of each nail and a seal plate of each nail by moving each of the nails through one of the holes to position the seal plate of each nail against an inside surface of the bore surrounding one of the holes and locating each of the nail seals within one of the holes, wherein the lower end of each of the nails is spaced apart from the outer casing.

12. The method according to claim 11, wherein the step of sealing each of the holes includes landing a dart in a landing seat of the cement packer assembly to apply a downward force to each of the nails.

13. The method according to claim 11, wherein the step of pushing the lower end of each of the nails through the inner casing includes engaging a sloped surface of the cement packer assembly with each of the nails, pushing the lower end of each of the nails through the inner casing at an angle relative to a central axis.

14. The method according to claim 11, further comprising after step (a), isolating the cement packer assembly from fluids and pressure within the bore, by setting a lower seal that extends across the bore and by setting an upper seal that has a ring shape and circumscribes the setting tool.

15. The method according to claim 11, further comprising de-coupling the setting tool from the cement packer assembly and retrieving the setting tool with a drill pipe, then drilling out the cement packer assembly.

16. An apparatus for cementing an annular space outside of an inner casing of a subterranean well, the apparatus comprising:

a cement packer assembly having:

a plurality of nails spaced around a circumference of the cement packer assembly, each of the nails having a lower end and a middle portion with a smaller outer dimension than an outer dimension of the lower end;

slips having outer surfaces selectively engaging an inner surface of a bore of the inner casing; and a seal plate associated with each nail, the seal plate having a curved outer surface for mating with the inner surface of the bore;

a setting tool coupled to the cement packer assembly; and a sloped surface configured to direct the lower end of each of the nails through the inner casing at an angle relative to a central axis so that each of the nails forms a hole in the inner casing.

17. The apparatus according to claim 16, further comprising a lower seal that extends across the bore and an upper seal that has a ring shape and circumscribes the setting tool.

18. The apparatus according to claim 16, wherein the cement packer assembly has a landing seat configured to receive a dart landed in the cement packer assembly to move each of the nails through one of a plurality of holes through the inner casing to position a seal plate of each nail against an inside surface of the bore surrounding one of the holes.

19. The apparatus according to claim 16, wherein each nail has a nail seal selectively sealingly positioned within one of a plurality of holes through the inner casing.

* * * * *